US010066406B2

(12) United States Patent
Hansort

(10) Patent No.: US 10,066,406 B2
(45) Date of Patent: Sep. 4, 2018

(54) ERECTION ANCHOR FOR PRECAST INSULATED CONCRETE WALL PANELS

(71) Applicant: Midwest Concrete & Masonry Supply, Inc., Naperville, IL (US)

(72) Inventor: Marinus Hansort, St. Pete Beach, FL (US)

(73) Assignee: Midwest Concrete & Masonry Supply, Inc., Naperville, IL (US)

( * ) Notice: Subject to any disclaimer, the term of this patent is extended or adjusted under 35 U.S.C. 154(b) by 0 days.

(21) Appl. No.: 15/684,388

(22) Filed: Aug. 23, 2017

(65) Prior Publication Data

US 2018/0058081 A1 Mar. 1, 2018

Related U.S. Application Data

(60) Provisional application No. 62/379,283, filed on Aug. 25, 2016.

(51) Int. Cl.

| | |
|---|---|
| ***E04G 21/14*** | (2006.01) |
| ***B28B 23/00*** | (2006.01) |
| ***E04C 2/288*** | (2006.01) |

(52) U.S. Cl.

CPC ..... *E04G 21/147* (2013.01); *B28B 23/005* (2013.01); *E04C 2/2885* (2013.01)

(58) Field of Classification Search

CPC ..... E04B 1/4185; E04B 2001/4192; B28B 23/005; E04G 21/142; E04G 21/147; B66C 1/666; E04C 5/162; E04C 5/163; E04C 5/166; E04C 5/168; E04C 5/18

See application file for complete search history.

(56) References Cited

U.S. PATENT DOCUMENTS

| | | | | |
|---|---|---|---|---|
| 4,930,269 | A | 6/1990 | Kelly et al. | |
| 5,857,296 | A * | 1/1999 | Niday | E04G 21/142 52/125.1 |
| 7,032,354 | B2 * | 4/2006 | Hansort | B66C 1/66 294/82.1 |
| D520,649 | S * | 5/2006 | Hansort | D25/133 |
| D559,499 | S | 1/2008 | Scott et al. | |
| D569,071 | S | 5/2008 | Scott et al. | |
| D686,486 | S * | 7/2013 | Densmore | D8/349 |
| 8,800,220 | B1 | 8/2014 | Francies, III | |
| 9,617,746 | B1 * | 4/2017 | Francies, III | E04G 21/142 |
| 2002/0134905 | A1 | 9/2002 | Domizio | |

(Continued)

*Primary Examiner* — Ryan D Kwiecinski

(74) *Attorney, Agent, or Firm* — Honigman Miller Schwartz and Cohn LLP

(57) ABSTRACT

A reinforced anchor assembly for lifting a tilt-up and precast insulated concrete panel provides an erection anchor that is configured to be precast in an edge portion of an insulated concrete panel and span between outer concrete layers of the insulated concrete panel. The erection anchor includes a central portion with a lifting hole configured to be positioned between the outer concrete layers for engage a lifting device. The erection anchor also includes lateral portions on opposing sides of the central portion that each include reinforcement apertures. A plurality of reinforcement bars are each configured to be precast in one of the outer layers of concrete and engage one of the reinforcement apertures in the erection anchor, such that the plurality of reinforcement bars support the insulated concrete panel under shear and tension loading forces.

16 Claims, 4 Drawing Sheets

(56) References Cited

U.S. PATENT DOCUMENTS

| | | | | |
|---|---|---|---|---|
| 2003/0208968 | A1* | 11/2003 | Lancelot, III | E04G 21/142 52/125.4 |
| 2003/0213206 | A1* | 11/2003 | Hansort | E04B 1/41 52/698 |
| 2005/0055958 | A1* | 3/2005 | Hansort | E04G 21/142 52/698 |
| 2008/0196324 | A1* | 8/2008 | Mackay Sim | E04G 21/142 52/125.4 |
| 2008/0203270 | A1* | 8/2008 | Connell | B28B 23/005 249/94 |
| 2009/0205268 | A1* | 8/2009 | Fletcher | B28B 23/005 52/125.4 |
| 2009/0320386 | A1* | 12/2009 | Mackay Sim | B28B 7/002 52/125.4 |
| 2012/0227335 | A1* | 9/2012 | Eklund | E04G 21/142 52/125.4 |
| 2013/0091785 | A1* | 4/2013 | Sladojevic | E04G 21/142 52/125.4 |
| 2013/0174499 | A1* | 7/2013 | Densmore | E04C 5/163 52/125.4 |
| 2015/0075090 | A1* | 3/2015 | Barraclouch | E04G 21/142 52/125.4 |

* cited by examiner

ERECTION ANCHOR FOR PRECAST INSULATED CONCRETE WALL PANELS

CROSS-REFERENCE TO RELATED APPLICATION

The present application claims the filing benefit of U.S. Provisional Application Ser. No. 62/379,283, filed Aug. 25, 2016, which is hereby incorporated herein by reference in its entirety.

FIELD OF THE INVENTION

The present invention generally relates to anchors used to lift or tilt-up precast concrete structures, and more particularly to erection anchors and assemblies for tilt-up and precast wall panels and building or structural panels.

BACKGROUND OF THE INVENTION

It is relatively common to use prefabricated or precast concrete structures in building constructions. For instance, concrete panels may be formed on a flat surface and subsequently lifted or tilted up to an upright or vertical orientation for use in forming a wall or other structural feature of a building. Accordingly, lifting anchors are often embedded in the concrete structures to facilitate handling, since these structures can be difficult to hoist and handle due to their weight, bulkiness, and susceptibility to damage, such as cracking, chipping, and other breakage.

SUMMARY OF THE PRESENT INVENTION

The present invention provides an erection anchor for a reinforced anchor assembly and a method of precasting an insulated concrete panel having insulation separating two layers of concrete and a reinforced lifting anchor disposed in or at an edge portion of the insulated concrete panel. According to one aspect of the present invention, a reinforced anchor assembly for lifting an insulated concrete panel includes an erection anchor that is configured to be precast in an edge portion of an insulated concrete panel and span through an insulation layer and between outer concrete layers of the insulated concrete panel. The erection anchor includes a central portion with a lifting hole that is configured to be positioned between the outer concrete layers for engaging a lifting device. The erection anchor also includes lateral portions on opposing sides of the central portion that each include at least one reinforcement aperture. A plurality of reinforcement bars are configured to be precast in the outer concrete layers and engage the reinforcement apertures in the erection anchor for supporting the insulated concrete panel under shear and tension loading forces at the lifting device.

According to another aspect of the present invention, an erection anchor is configured to be precast in an edge portion of an insulated precast concrete panel for lifting the panel. The erection anchor includes a central portion that has a lifting feature that is configured to be disposed at an insulation layer between outer concrete layers of an insulated concrete panel. The erection anchor also includes lateral portions on opposing sides of the central portion that are configured to be disposed in the outer concrete layers of the insulated concrete panel. The lateral portions each include at least two reinforcement apertures for engaging a tension bar and a shear bar that, respectively, protrude away from the edge portion of the insulated concrete panel and along the edge portion of the insulated concrete panel.

According to yet another aspect of the present invention, a method of forming an insulated concrete panel with a reinforced lifting anchor includes providing a plurality of reinforcement bars that are each configured to be precast in outer concrete layers that are separated by an insulation layer of the insulated concrete panel. An erection anchor is positioned at an edge portion of the insulated concrete panel so as to span between the outer concrete layers of the insulated concrete panel. A central portion of the erection anchor has a lifting hole positioned between the outer concrete layers for engage a lifting device. The plurality of reinforcement bars are engaged with lateral portions of the erection anchor disposed in the outer concrete layers for supporting the insulated concrete panel under shear and tension loading forces applied at the lifting device.

These and other objects, advantages, purposes, and features of the present invention will become apparent upon review of the following specification in conjunction with the drawings.

DETAILED DESCRIPTION OF EMBODIMENTS

Figure 3:
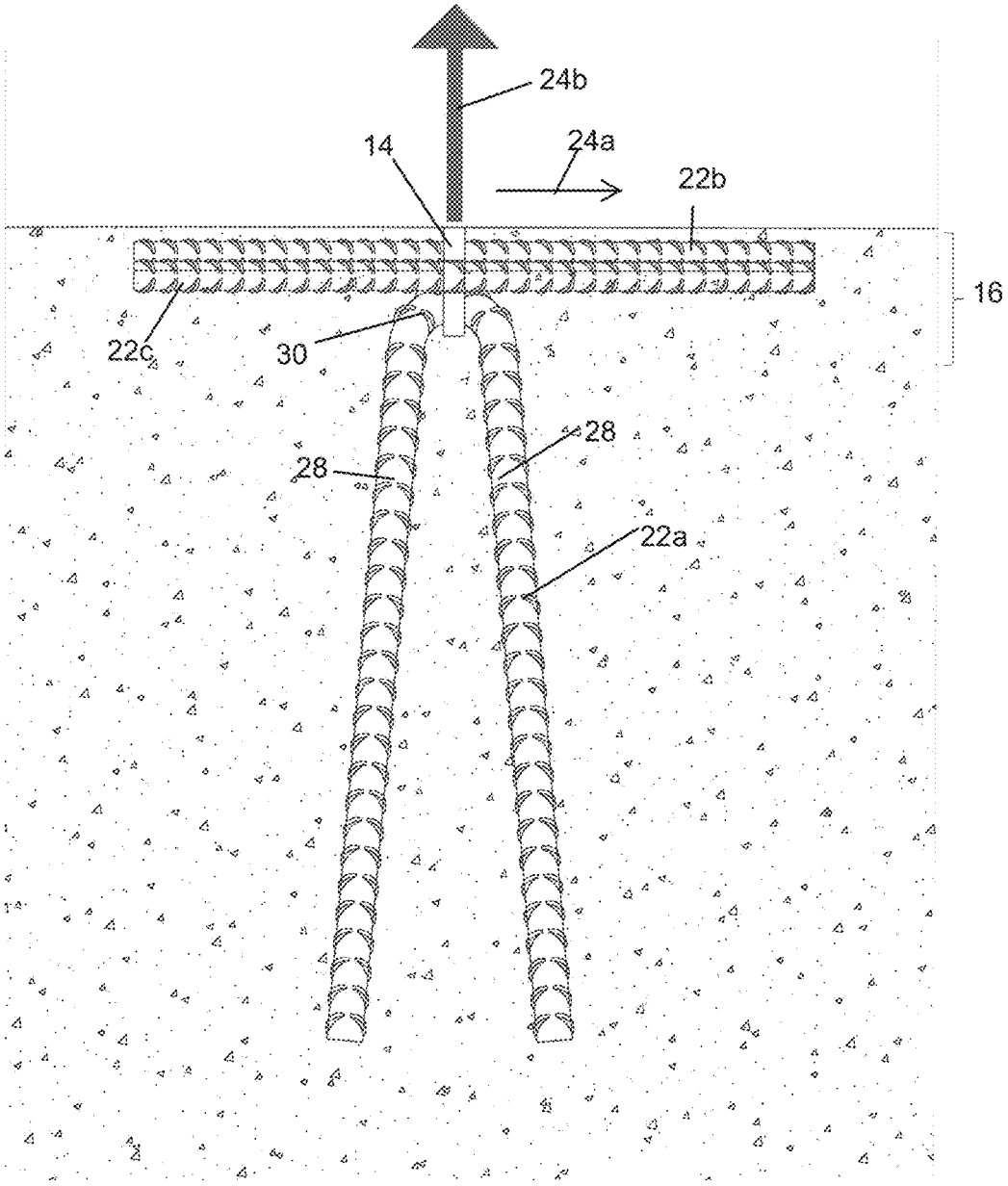
FIG. 3 is a side elevational view of the reinforced anchor assembly and the insulated concrete panel shown in FIG. 1.
Figure 4:
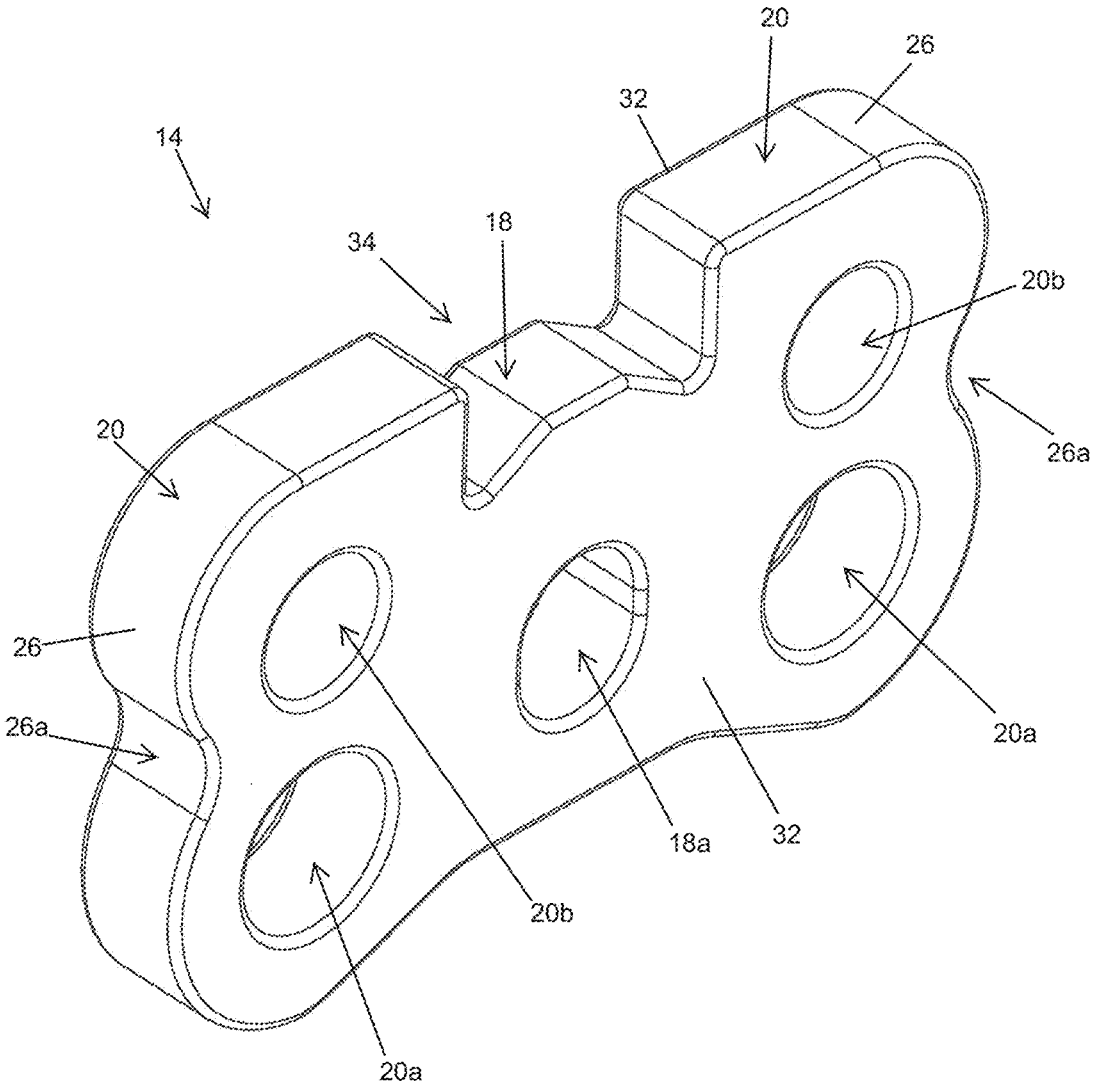
FIG. 4 is a perspective view of an erection anchor of the reinforced anchor assembly, shown separate from a concrete structure.

Referring now to the drawings and the illustrative embodiments depicted therein, a reinforced anchor assembly 10 is provided as a supported and secure connection location for lifting or raising a tilt-up and precast insulated concrete panel 12 or structure or the like. The reinforced anchor assembly 10 provides an erection anchor 14 that may be precast in an edge portion 16 (FIG. 2) of the insulated concrete panel 12 and spans within and between outer concrete layers 12*a* of the insulated concrete panel 12. The erection anchor 14 includes a central portion 18 with a lifting feature or hole 18*a* and ears or lateral portions 20 on opposing sides of the central portion 18 that each include at least two reinforcement apertures 20*a*, 20*b* (FIG. 4). A plurality of reinforcement bars or members (FIG. 1), such as tension bars 22*a* and shear bars 22*b*, are each precast in one of the outer layers of concrete 12*a* and may engage one of the reinforcement apertures 20*a*, 20*b* in the erection anchor 14, such that the plurality of reinforcement bars (22*a*, 22*b*, 22*c*) support the insulated concrete panel under shear loading forces 24*a* and tension loading forces 24*b* (FIGS. 2-3). It is contemplated that multiple erection anchors 14 may be disposed along the edge portion of a single concrete panel 12 and may engage common reinforcement bars.

Figure 1:
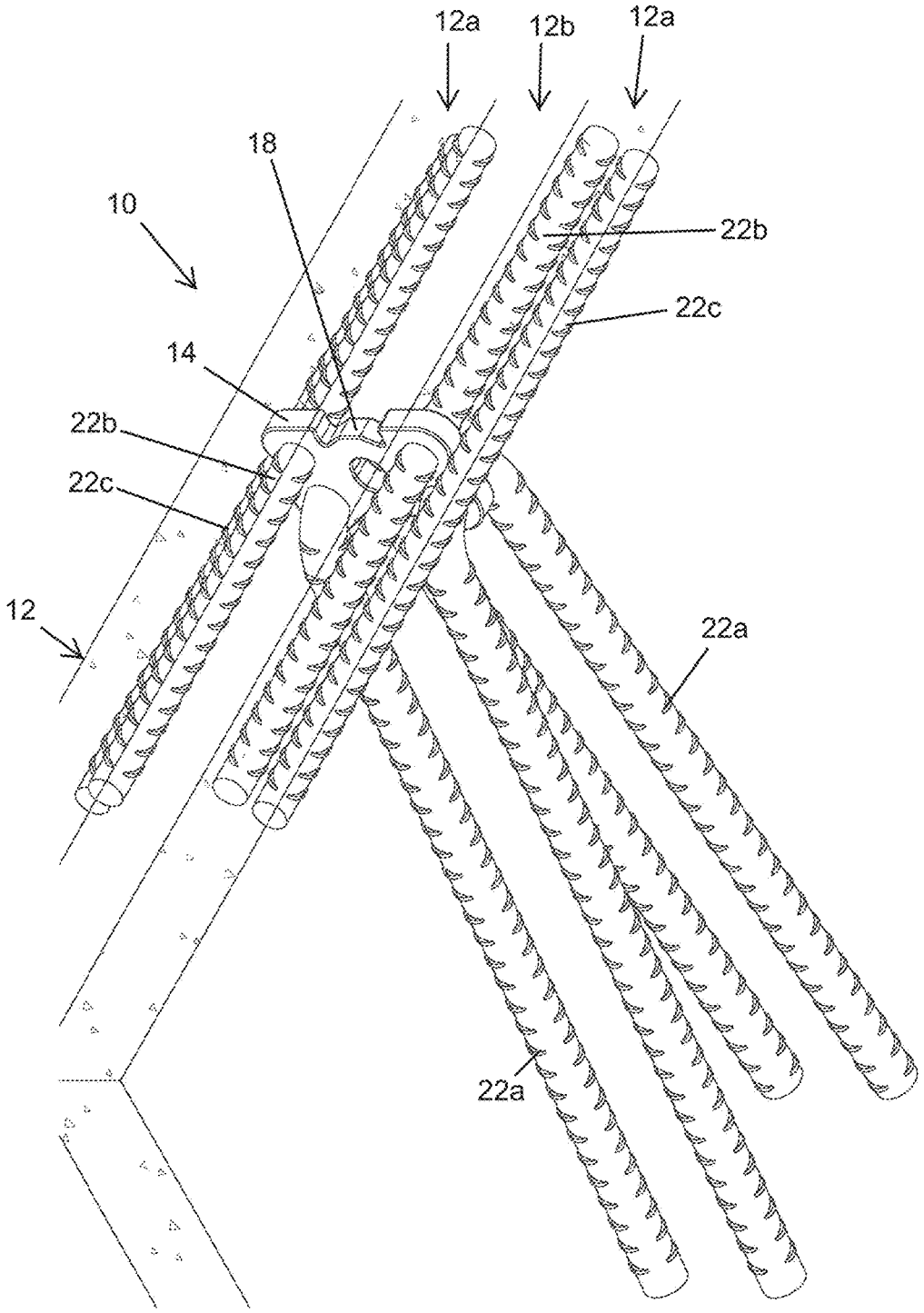
FIG. 1 is a perspective view of a reinforced anchor assembly disposed in an insulated concrete panel, in accordance with the present invention.
Figure 2:
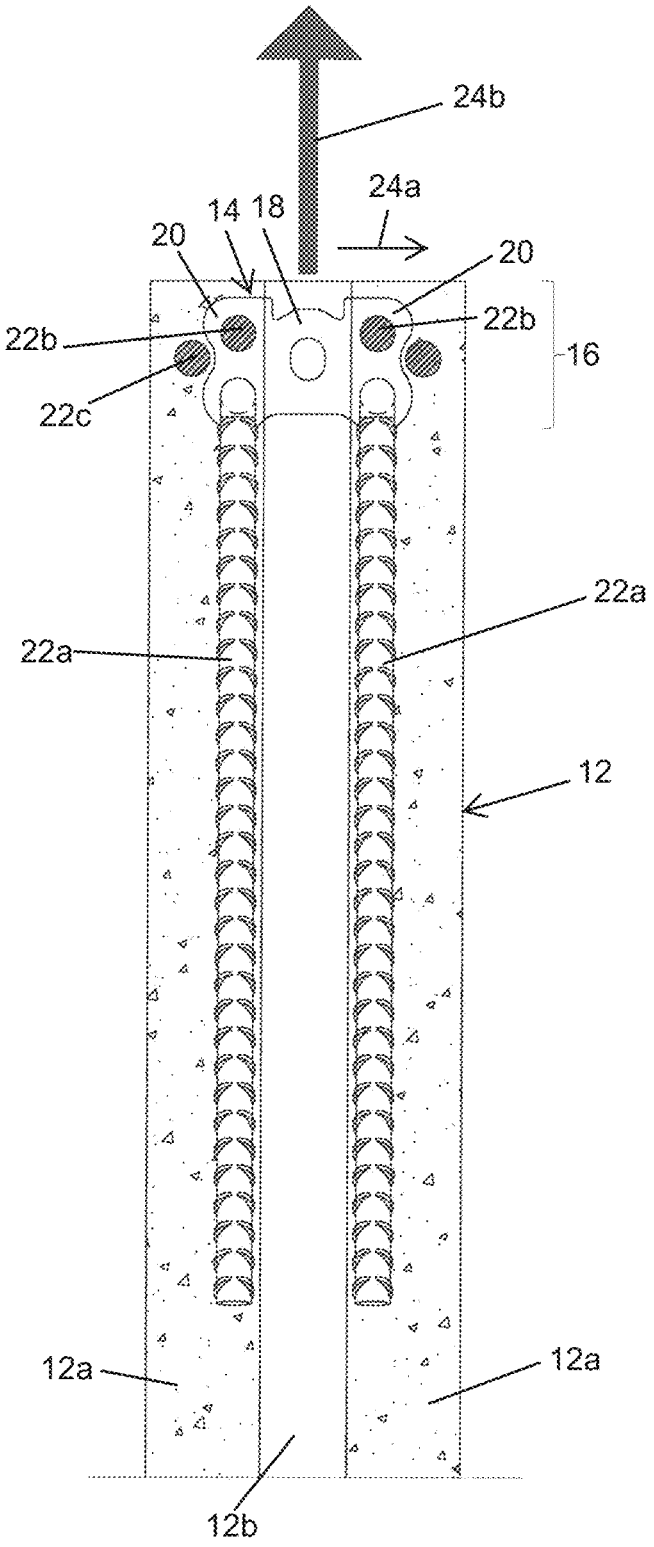
FIG. 2 is an end elevational view of the reinforced anchor assembly and the insulated concrete panel shown in FIG. 1.

The insulated concrete panel 12 may be formed or precast by horizontally forming the two outer layers 12*a* or wythes of concrete with an insulation layer 12*b* cast between the concrete layers, as shown for example in FIGS. 1 and 2. Although separated by the insulation layer 12*b*, the concrete layers 12*a* may be joined during forming with reinforcement ties that extend through the insulation layer 12*b* and between the concrete layers 12*a*, such as a wave-shaped wire made of plastic or basalt fiber reinforced polymer that can interconnect between pre-stressed cables that may also extend through the concrete layers for reinforcement. As such, the ties may use a polymeric material to substantially reduce or prevent high thermal conductivity paths from extending between the concrete layers 12*a*, while also not adding substantially to the overall weight of the relatively lightweight concrete panel. Due to the relatively thin thickness and separation of the concrete layers 12*a*, the insulated concrete panel 12 can be more susceptible to damage, such as cracking or separating from the insulation layer 12*b*, when lifting and raising the panel from its generally horizontal forming orientation to its desired use position, such as a substantially vertical orientation for use of the panel 12 as a wall of a structure.

The erection anchor 14 of the reinforced anchor assembly 10 is precast in the edge portion 16 (FIG. 2) of the insulated concrete panel 12 so as to extend between the outer concrete layers 12*a* in alignment with the thickness of the insulated concrete panel 12. As such, the erection anchor spans though the insulation layer 12*b* to position the lateral portions 16 of the erection anchor 14 within and generally encompassed by the outer concrete layers 12*a* of the insulated concrete panel 12. The width of the erection anchor 14 between the lateral portions 20 is generally less than the thickness dimension of the insulated concrete panel 12, so that the erection anchor 14 does not protrude from the outer side surfaces of the panel 12. The central portion 18 of the erection anchor 14 positions the lifting feature or hole 18*a* at a central location between the outer concrete layers 12*a* for engage a lifting device, such as a clevis pin, hook, or chain loop or the like that is manipulated by a crane or other piece of equipment. As shown for example in FIG. 4, the lifting hole 18*a* includes a generally oval shape, although other hole shapes or features may be formed to engage the corresponding lifting device. It is also understood that during fabrication, the central portion 18 of the erection anchor 14 may be partially surrounded by a removable form or insert that prevents insulation, such as foam or liquefied expanding insulation, from covering or concealing the lifting hole 18*a*.

The ears or lateral portions 20 of the erection anchor 14 extend from opposing sides of the central portion 18 to be disposed in the outer concrete layers 12*a* of the insulated concrete panel 12. Each lateral portion 20 may include at least two reinforcement apertures 20*a*, 20*b*, which are used for engaging a reinforcement bar that extends within the outer concrete layer 12*a*. As shown in FIG. 4, the lateral portions 20 include an inner reinforcement aperture 20*a* and an outer reinforcement aperture 20*b*, where the inner reinforcement aperture 20*a* has a smaller diameter than the outer reinforcement aperture 20*b*. However, it is contemplated that the reinforcement apertures may have alternative sizes shapes to engage the corresponding reinforcement bars. The lateral portions 20 of the erection anchor 14 also include a curved outer edge 26 that has a recessed portion or channel 26*a* that is configured to be arranged adjacent to an additional reinforcement bar, such as shown in FIG. 2 as an additional shear bar 22*c*, precast in the outer concrete layers 12*a* between the erection anchor 14 and the outer side surface of the panel 12. The channel 26*a* is shown positioned on the outer edge 26 at a position generally centered between the reinforcement apertures 20*a*, 20*b*. It is contemplated that additional apertures and channels, as well as alternatively shaped and located apertures and channels may be provided on additional embodiments of the anchor 14.

With respect to the plurality of reinforcement bars, including the tension bars 22*a*, shear bars 22*b*, and additional reinforcement bars 22*c*, each are configured to be precast in one of the outer layers 12*a* of concrete and positioned to support and/or engage one of the reinforcement apertures 20*a*, 20*b* or channels 26*a* for transferring the weight of the concrete panel 12 to the anchor 14. Thus, the reinforcement bars typically do not intersect the insulation layer 12*b*, and the erection anchor 14 is generally the only component of the reinforced anchor assembly 10 spanning between the concrete layers 12*a*. The plurality of reinforcement bars (22*a*, 22*b*, 22*c*) support the insulated concrete panel under shear and tension loading forces, such as shown with vector arrows 24*a*, 24*b* in FIGS. 2 and 3, applied at the central portion 18, such as with a lifting device. The tension bars 22*a* are each configured to be precast in one of the outer concrete layers and protrude away from the edge portion 16 and along the insulated concrete panel 12. For example, as shown in FIGS. 2 and 3, the tension bars 22*a* each have a V-shape that includes a pair of legs 28 and a leg-connecting section 30 between the pair of legs that engages the inner reinforcement aperture 20*a* in the erection anchor. The pair of legs 28 of the tension bar 22*a* each protrude away from the anchor 14 into a body portion of the respective concrete layer 12*a*. The shear bars 22*b* are also each configured to be precast in one of the outer concrete layers 12*a* and engage one of the reinforcement apertures in the erection anchor 14 for supporting the insulated concrete panel 12 under shear or sideways forces 24*a* when raising or lifting the panel 12. The shear bars 22*b*, such as shown in FIG. 3, may extend along the edge portion 16 of the insulated concrete panel 12. Optionally, the additional reinforcement bars 22*c* may similarly be provided to extend in generally parallel alignment with the shear bars 22*b* along the edge portion 16 for additional strength for sideways lifting. The illustrated reinforcement bars also include an outer surface texturing or ribbing that can improve engagement or bonding with the compressed concrete structure. Further, it is contemplated that additional embodiments of the reinforcement bars may be alternatively shaped and positioned from those illustrated herein.

To provide sufficient support, the erection anchor 14 includes a single member or piece, such as made of a metal, having opposing substantially planar side surfaces 32, such as a piece cut from a thick metal plate. As shown for example in FIG. 4, the planar side surfaces 32 extend over the central portion 18 and the lateral portions 20 of the erection anchor 14. Also, the lifting hole 18*a* and/or the reinforcement apertures 20*a*, 20*b* extended substantially orthogonally between the planar surfaces 32. Also, the outer edges 26 of the lateral portions 20 of the erection anchor 14 include a curved outer edge that extends substantially orthogonally between the planar side surfaces 32. Also, a notch 34 is forced at the outer or upper edge of the central portion 18 to reduce the necessary material of the erection anchor 14. Thus, the overall shape of the erection anchor 14, such as the outer edges and holes or apertures in the erection anchor 14, may be formed by flame, plasma, waterjet, or laser cutting and/or open die drop forging or the like, so as to use the minimum amount of material to transfer loads from the reinforcement bars to the anchor 14 for lifting in tension 24*b* and sideways 24*a*. For example, by dropforging the shape of the anchor, the material properties of tensile can be increased by around 20%, such that less material may be used to meet the loading requirements of the anchor 14. Also, it is desirable to form the anchor with the minimum amount of material to keep the anchor light weight and avoid any unnecessary high thermally conductive material extending between the outer layers of concrete.

Accordingly, the method for forming an insulated concrete panel with a reinforced lifting anchor may include providing a concrete form for forming the insulated concrete panel in a generally horizontal orientation, where reinforcement bars are positioned at or near the edge portion of the concrete form when forming the first layer of concrete. With the reinforcement bars set or immediately prior to positioning the reinforcement bars, the first outer layer of concrete can be poured into the form. The preformed metal erection anchor is positioned at an edge portion of the form with one of the lateral portions disposed in the first layer of concrete and engaging the reinforcement bars disposed therein. The remaining portions of the erection anchor may be left exposed out of the first concrete layer for extending through the insulation layer to engage the second concrete layer. A central portion of the erection anchor may have a lifting hole for engage a lifting device that is generally surrounded by the insulation layer that is disposed over the first layer of concrete. After setting the insulation layer, the reinforcement bars may be positioned in the area over the insulation layer in engagement with the other lateral portion of the erection anchor for being cast in the second layer of concrete. The lateral portions of the erection anchor can be engaged with the plurality of reinforcement bars extending through reinforcement apertures, such that the plurality of reinforcement bars may be configured to support the insulated concrete panel under shear and tension loading forces.

For purposes of this disclosure, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in this specification are simply exemplary embodiments of the inventive concepts defined in the appended claims. Hence, specific dimensions and other physical characteristics relating to the embodiments disclosed herein are not to be considered as limiting, unless the claims expressly state otherwise.

Changes and modifications in the specifically described embodiments may be carried out without departing from the principles of the present invention, which is intended to be limited only by the scope of the appended claims as interpreted according to the principles of patent law. The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

The invention claimed is:

1. A reinforced anchor assembly for lifting an insulated concrete panel, said reinforced anchor assembly comprising:

an erection anchor configured to be precast in an edge portion of an insulated concrete panel and span through an insulation layer and between outer concrete layers of the insulated concrete panel;

wherein the erection anchor includes a central portion with a lifting hole configured to be positioned between the outer concrete layers for engaging a lifting device;

wherein the erection anchor includes lateral portions on opposing sides of the central portion that each include two reinforcement apertures and an outer edge that has a recessed portion that protrudes inward between the two reinforcement apertures;

a plurality of reinforcement bars that are configured to be precast in the outer concrete layers;

wherein the plurality of reinforcement bars engage the reinforcement apertures in the erection anchor for supporting the insulated concrete panel under shear and tension loading forces at the lifting device; and wherein an additional one of the plurality of reinforcement bars is disposed at each of the recessed portions of the outer edge of the erection anchor for further supporting the insulated concrete panel under shear loading forces at the lifting device.

2. The reinforced anchor assembly of claim 1, wherein the erection anchor comprises a metal member having opposing side surfaces that extend between the lateral portions of the erection anchor, and wherein the reinforcement apertures extended substantially orthogonally between the opposing surfaces.

3. The reinforced anchor assembly of claim 1, wherein at least two of the plurality of reinforcement bars that are disposed at the recessed portion of the outer edge and engaging one of the reinforcement apertures are in substantial alignment with each other.

4. The reinforced anchor assembly of claim 1, wherein the plurality of reinforcement bars include tension bars that are each configured to be precast in one of the outer concrete layers and each engage one of the reinforcement apertures in the erection anchor for supporting the raised insulated concrete panel under tension loading forces at the lifting device.

5. The reinforced anchor assembly of claim 4, wherein the tension bars comprise a bent section along a length of each tension bar to provide a V-shape, and wherein the bent section is configured to engage one of the reinforcement apertures in the erection anchor.

6. The reinforced anchor assembly of claim 1, wherein the plurality of reinforcement bars include shear bars that are configured to be precast in one of the outer concrete layers and engage one of the reinforcement apertures in the erection anchor for supporting the raised insulated concrete panel under shear loading forces at the lifting device, and wherein the shear bars are disposed at each of the recessed portions of the outer edge of the erection anchor for further supporting the insulated concrete panel under shear loading forces at the lifting device.

7. The reinforced anchor assembly of claim 1, wherein the plurality of reinforcement bars comprises (i) tension bars that are disposed through the reinforcement apertures and are configured to extend within the concrete layer and away from the edge portion and (ii) shear bars that are disposed at the reinforcement apertures and the recessed portions and are configured to extend along the edge portion of the insulated concrete panel.

8. The reinforced anchor assembly of claim 1, wherein a width of the erection anchor between the lateral portions is generally less than a thickness of the insulated concrete panel between outside surfaces of the concrete layers.

9. The reinforced anchor assembly of claim 1, wherein a first aperture of two reinforcement apertures is configured to be nearest to the edge portion of the insulated concrete panel, and wherein the plurality of reinforcement bars include shear bars that engage the first aperture at each of the lateral portions of the erection anchor.

10. An erection anchor configured to be precast in an edge portion of an insulated precast concrete panel for lifting the panel, said erection anchor comprising:

a central portion having a lifting opening configured to be disposed at an insulation layer between outer concrete layers of an insulated concrete panel;

lateral portions on opposing sides of the central portion that are configured to be disposed in the outer concrete layers of the insulated concrete panel;

wherein the lateral portions each include two reinforcement apertures for engaging a tension bar and a shear bar that, respectively, protrude away from the edge portion of the insulated concrete panel and along the edge portion of the insulated concrete panel; and wherein the lateral portions of the erection anchor each include an outer edge that has a recessed portion that protrudes inward toward the central portion and is configured to receive an additional reinforcement bar that is disposed in one of the outer concrete layers in substantial alignment with the shear bars.

11. The erection anchor of claim 10, wherein the erection anchor includes a metal member having opposing substantially planar surfaces that extend along the central portion and the lateral portions of the erection anchor in generally planar alignment with each other.

12. The erection anchor of claim 11, wherein the reinforcement apertures extended substantially orthogonally between the opposing substantially planar surfaces of the metal member.

13. The erection anchor of claim 12, wherein the recessed portions at the outer edges of the erection anchor extend substantially orthogonally between the opposing substantially planar surfaces of the metal member so as to be configured to receive the additional reinforcement bars in substantial alignment with the shear bars.

14. The erection anchor of claim 10, wherein the reinforcement apertures are configured to engage a bent section along a length of each tension bar, and wherein the bent section is configured to provide a V-shape.

15. The erection anchor of claim 11, wherein a width of the erection anchor between the lateral portions is generally less than a thickness of the insulated concrete panel between outside surfaces of the concrete layers.

16. The erection anchor of claim 12, wherein the recessed portions each protrudes inward between the two reinforcement apertures.

* * * * *